United States Patent [19]

Sung et al.

[11] Patent Number: 4,643,737

[45] Date of Patent: Feb. 17, 1987

[54] POLYOL-ACID ANHYDRIDE-N-ALKYL-ALKYLENE DIAMINE REACTION PRODUCT AND MOTOR FUEL COMPOSITION CONTAINING SAME

[75] Inventors: Rodney L. Sung, Fishkill; Robert H. Jenkins, Jr., Walden, both of N.Y.

[73] Assignee: Texaco Inc., White Plains, N.Y.

[21] Appl. No.: 791,638

[22] Filed: Oct. 25, 1985

[51] Int. Cl.[4] ..... C10L 1/22

[52] U.S. Cl. ..... 44/63; 44/71

[58] Field of Search ..... 44/71, 63

[56] References Cited

U.S. PATENT DOCUMENTS

| | | | |
|---|---|---|---|
| 4,348,210 | 9/1982 | Sung | 252/392 |
| 4,384,872 | 5/1983 | Kester et al. | 44/56 |
| 4,419,105 | 12/1983 | Sung | 44/53 |

*Primary Examiner*—Mrs. Y. Harris-Smith

*Attorney, Agent, or Firm*—Robert A. Kulason; James J. O'Loughlin; Vincent A. Mallare

[57] ABSTRACT

Gasoline of reduced combusiton chamber deposits attained by addition of, as an additive, a reaction product of alpha-hydroxy omega hydroxy-poly (oxyethylene) poly (oxypropylene) poly (oxyethylene) block copolymer, maleic anhydride and N-tallow-1,3-propane diamine.

10 Claims, No Drawings

POLYOL-ACID ANHYDRIDE-N-ALKYL-ALKYLENE DIAMINE REACTION PRODUCT AND MOTOR FUEL COMPOSITION CONTAINING SAME

BACKGROUND OF THE INVENTION

1. Field of the Invention

This invention relates to a reaction product, and to a motor fuel composition containing same. More particularly, this invention relates to the reaction product of maleic anhydride, a polyol, and an N-alkyl-alkylene diamine and to a motor fuel composition containing same.

Incomplete combustion of hydrocarbonaceous motor fuels in internal combustion engines is a common problem which often results in the formation and accumulation of carbon deposits at various locations within the engine. The presence of carbon deposits in the combustion chambers of an internal combustion engine interferes with the operating efficiency of the engine. Among other problems, these carbon deposits tend to accumulate within the combustion chambers, thus reducing the space available for combustion in the chambers during the compression of the fuel-air mixture. Consequently, a higher than design compression ratio is obtained, resulting in serious engine knocking. Under these conditions, the energy of combustion is not being effectively harnessed. Moreover, a prolonged period of engine knocking can cause stress fatigue and wear in vital parts of the engine. This octane requirement increase phenomenon (ORI) is well known in the art. One solution for this problem is the use of higher octane fuels to alleviate engine knock; however, higher octane fuels are expensive. It would thus be advantageous if ORI could be controlled by reducing or preventing the deposition of carbon deposits in the combustion chambers of the engine.

In addition, the presence and accumulation of carbon deposits in and around the carburetor restrict the flow of air through the carburetor at idle and at low speeds, resulting in an overrich fuel mixture. This condition produces further incomplete fuel combustion, resulting in rough engine idling and engine stalling, as well as excessive hydrocarbon and carbon monoxide exhaust emissions into the atmosphere. It would thus be desirable in view of both engine operability and overall air quality to provide a fuel composition which minimizes or overcomes the above-described problems.

2. Information Disclosure Statement

U.S. Pat. No. 4,419,105 discloses the use of the reaction product of maleic anhydride and certain amines or diamines as corrosion inhibitors in alcohols.

U.S. Pat. No. 4,321,062 discloses the use of the reaction product of maleic anhydride, certain phenols, and certain alkyl-alkylene diamines as a corrosion inhibitor and carburetor detergent additive in motor fuels.

U.S. Pat. No. 4,290,778 discloses the use of the reaction product of a hydrocarbyl alkoxyalkylene diamine and maleic anhydride as a corrosion inhibitor and carburetor detergent additive in motor fuels.

U.S. Pat. No. 4,207,079 discloses the use of the reaction product of maleic anhydride and certain alkyl-alkylene diamines as a corrosion inhibitor and carburetor detergent additive in motor fuels.

U.S. Pat. No. 4,144,034 discloses the use of the reaction product of a polyether amine and maleic anhydride as a carburetor detergent and corrosion inhibitor in motor fuels.

U.S. Pat. No. 3,773,479 discloses the use of the reaction product of maleic anhydride and alkyl or alkylene amines as a carburetor detergent, corrosion inhibitor, and anti-icing additive in motor fuels.

SUMMARY OF THE INVENTION

It has now been discovered that the reaction product of a polyol, a dibasic acid anhydride, and an N-alkyl alkylene diamine, has utility as an ORI inhibitor and carburetor detergent additive when employed in a motor fuel composition. The fuel composition comprises:

(a) a major problem of normally liquid hydrocarbon fuel; and (b) a minor amount, as a deposit inhibitor additive, of a condensate product of a process comprising:

(i) reacting a polyol $$HO(CH_2CH_2O)_a(\underset{\underset{CH_3}{|}}{CH_2CH_2O})_b(CH_2CH_2O)_cH$$

where a+c is about 10 to about 80 and b is about 5 to about 70, with dibasic acid anhydride, thereby forming an ester of maleic acid;

(ii) reacting the ester of maleic acid with an N-alkyl alkylene diamine, thereby forming the condensate product; and (iii) recovering said condensate product.

The N-alkyl alkylene diamine can be represented by the formula $$R'—NH—R''—NH_2$$

where R' is a ($C_{12}$–$C_{18}$) hydrocarbon group and R'' is a ($C_3$–$C_{12}$) hydrocarbon group.

The dibasic acid anhydride is represented by the formula

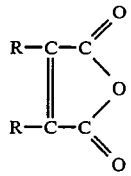

wherein R can be H, $CH_3$, or $C_2H_5$.

This invention is also directed to a motor fuel composition containing the prescribed reaction product which exhibit substantially reduced ORI tendencies and improved carburetor detergency properties.

DETAILED EMBODIMENTS OF THE INVENTION

The novel reaction product of this invention is prepared by reacting maleic anhydride, a polyol and an N-alkyl-alkylene diamine. The polyol reactant is represented by the formula $$HO(CH_2CH_2O)_a(\underset{\underset{CH_3}{|}}{CHCH_2O})_b(CH_2CH_2O)_cH$$

wherein a+c is about 10 to about 80, preferably from about 60 to about 80 and more preferably about 70, and b is about 5 to about 70, preferably from about 10 to about 30. The molecular weight of the polyol may range from about 800 to about 2000. Examples of the polyols which may be employed herein include those listed below in Table I.

TABLE I

A. The Wyandotte Pluronic L-43 brand of poly(oxyethylene) poly(oxypropylene) poly(oxyethylene) polyol having a molecular weight $\overline{M}_n$ of 1200 and containing 30 w% derived from poly(oxyethylene) and 70 w% derived from poly(oxypropylene). In this product, b is 16.6 and a+c is 5.5.

B. The Wyandotte Pluronic L-63 brand of poly(oxyethylene) poly(oxypropylene) poly(oxyethylene) polyol having a molecular weight $\overline{M}_n$ of 1750 and containing 30 w% derived from poly(oxyethylene) and 70 w% derived from poly(oxypropylene). In this product, b is 21.1 and a+c is 11.9.

C. The Wyandotte Pluronic L-62 brand of poly(oxyethylene) poly(oxypropylene) poly(oxyethylene) polyol having a molecular weight $\overline{M}_n$ of 1750 and containing 20 w% derived from poly(oxyethylene) and 80 w% derived from poly(oxypropylene). In this product, b is 24.1 and a+c is 8.

D. The Wyandotte Pluronic L-31 brand of poly(oxyethylene) poly(oxypropylene) poly(oxyethylene) polyol having a molecular weight $\overline{M}_n$ of 950 and containing 10 w% derived from poly(oxyethylene) and 90 w% derived from poly(oxypropylene). In this product, b is 14.7 and a+c is 2.2.

E. The Wyandotte Pluronic L-64 brand of poly(oxyethylene) poly(oxypropylene) poly(oxyethylene) polyol having a molecular weight $\overline{M}_n$ of 1750 and containing 40 w% derived from poly(oxyethylene) and 60 w% derived from poly(oxypropylene). In this product, b is 18.1 and a+c is 15.9.

The dibasic acid anhydrides of the present invention are represented by the formula

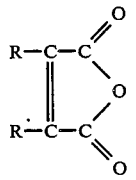

where R is H, $CH_3$— or $C_2H_5$—.

Accordingly, the dibasic acid anhydrides may include the following:

maleic anhydride
alpha-methyl maleic anhydride
alpha-ethyl maleic anhydride
alpha, beta-dimethyl maleic anhydride The preferred dibasic acid anhydride is maleic anhydride.

The amines which may be employed in the present process include polyamines preferably diamines, which bear at least one primary amine—$NH_2$ group and at least one substituted primary amine group. The latter may be di-substituted, but more preferably it is monosubstituted. The hydrocarbon nucleous of the amine may be aliphatic or aromatic including alkyl, alkaryl, aralkyl, aryl, or cyclalkyl in nature. The preferred amine has the formula $$R'—NH—R''—NH_2$$

wherein R' is a $C_{12}$–$C_{18}$ hydrocarbon group and R'' is a $C_3$–$C_{12}$ hydrocarbon group. In the preferred amines, i.e., mono-substituted primary amines, R' may be an alkyl, alkaryl, aralkyl, aryl, or cycloalkyl hydrocarbon group and R'' may be an alkylene, aralkylene, alkarylene, arylene, or cycloalkylene hydrocarbon group.

Illustrative of the preferred N-primary alkyl-alkylene diamines may include those listed below in Table II.

TABLE II

A. The Duomeen O brand of N-oleyl-1,3,-propane diamine.
B. The Duomeen S brand of N-stearyl-1,3-propane diamine.
C. The Duomeen T brand of N-tallow-1,3-propane diamine.
D. The Duomeen C brand of N-coco-1,3-propane diamine.

The most preferred diamine, R'—NH—R''—$NH_2$, is that where the R'' group is propylene, —$CH_2CH_2CH_2$— and the R' group is a $C_{12}$–$C_{18}$ n-alkyl group.

In accordance with the present invention, the process comprises the addition to the hydrocarbon fuel, of a minor deposit-inhibiting amount of, as a deposit-inhibiting additive, a reaction product of (a) a polyol, (b) maleic anhydride, and (c) an N-alkyl-alkylene diamine.

The reaction, i.e., condensate, product is prepared by first reacting maleic anhydride with the prescribed polyol. The reaction of about 1 to 2 mole, preferably about 1 mole maleic anhydride with abot 1 to 2 moles, preferably about 1.5 mole polyol is preferably carried out in the presence of a solvent. Suitable solvents include hydrocarbons boiling in the gasoline boiling range of about 30° C. to about 200° C. Generally, this will include saturated and unsaturated hydrocarbons having from about 5 to about 10 carbon atoms. Specific suitable hydrocarbon solvents include hexane, cyclohexane, benzene, toluene, and mixtures thereof. Xylene is the preferred solvent. The solvent can be present in an amount of up to about 90% by weight of the total reaction mixture. The mixture is heated for 2 hours, then cooled to 60° C. and then add 1 mole of N-alkyl alkylene diamine. The mixture is heated at 100° C. for 2 more hours, where upon it is filtered and stripped under vacuum.

In a preferred method for preparing the reaction product, the 1 mole maleic anhydride and 1 mole of Pluronic L-31 are combined with the solvent xylene and reacted at a temperature of about 100° C. The reaction mixture is maintained at this temperature for approximately 2 hours. The mixture is then cooled to about 60° C., whereupon the 1 mole of Duomeen C is added. The new mixture is then reacted at about 100° C. for approximately 2 hours. The reaction product can than be separated from the solvent using conventional means, or left in admixture with some or all of the solvent to facilitate addition of the reaction product to gasoline or another motor fuel composition. The final reaction product structure (as evidenced by elemental analysis, IR analysis, and NMR analysis).

In the process illustrated below, initially, maleic anhydride (A) is reacted with a polyol (B) to form an ester of maleic acid (C) then, the ester of maleic acid (C) is reacted with a N-alkyl alkylene diamine (D) to form the condensate product (E) of polyol, maleic anhydride, and N-alkyl alkylene diamine. Accordingly, the condensate product (E) is recovered.

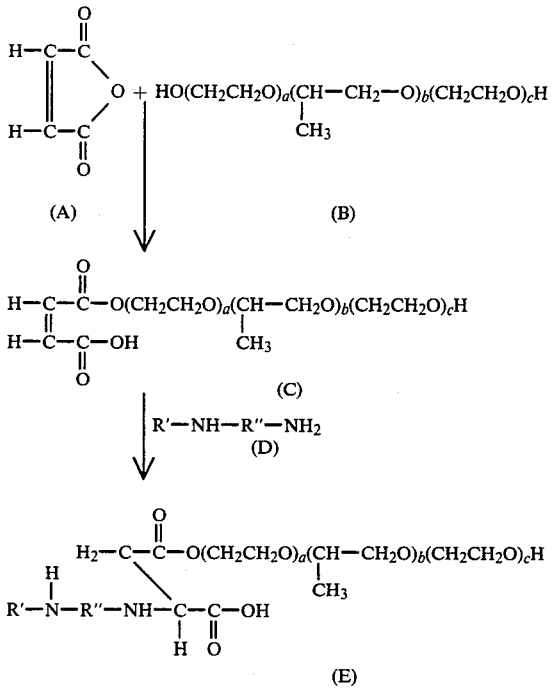

wherein a+c is about 60 to about 80, preferably about 70 and b is about 5 to about 70, preferably about 10 to about 30; R' is a $C_{12}$–$C_{18}$ alkyl, alkaryl, aralkyl, aryl, or cycloalkyl hydrocarbon group and R'' is a ($C_3$–$C_{12}$) alkylene, aralkylene, alkarylene, arylene or cycloalkylene hydrocarbon group boiling in the gasoline boiling range. Commonly these fuels may be characterized as provided below in Table III.

TABLE III

| Property | Broad | Preferred | Typical |
|---|---|---|---|
| ibp (°F.) | 80–100 | 85–95 | 92 |
| 50% bp (°F.) | 150–300 | 200–250 | 216 |
| 90% bp (°F.) | 300–450 | 330–400 | 334 |
| API Gravity | 50–65 | 55–60 | 61 |

These fuels may be fully formulated gasoline compositions (containing standard commercial additive packages) having a road octane number (RON) of 80–98, preferably 85–95, say 93 and a motor octane number (MON) of 75–95, preferably 80–90, say 83. The fuels may be summer or winter grades, high or low octane, leaded or unleaded, etc. Unleaded gasolines may particularly benefit from practice of this invention.

It has been found that a motor fuel composition containing the reaction product of the instant invention is effective in minimizing and reducing gasoline internal combustion engine deposit.

This is an improvement in the performance which may reduce the incidence of knock. This invention was tested by the Combustion Chamber Deposit Screening Test (CCDST). In this test, the deposit-forming tendencies of a gasoline are measured; and the amount of deposit correlates with the ORI performance observed in car tests and engine tests. The amount of deposit is compared to a high reference (a standard gasoline known to have a high deposit) and as a low reference (an unleaded base fuel which is known to have a low deposit). Practice of this invention desirably permits attainment of a CCDST rating or equivalent below that of the low reference.

THE COMBUSTION CHAMBER DEPOSIT SCREEN TEST (CCDST)

The Combustion Chamber Deposit Screening Test (CCDST) determines whether the additive is effective as a deposit control additive to prevent octane requirement increase. In this test, the additive sample is dissolved in unleaded gasoline in a concentration of 100 pounds per thousand barrels (PTB). In a nitrogen/air environment the test fuel is then atomized and sprayed onto a heated aluminum tube. After 100 minutes, the deposits which have formed on the tube are weighed. (Gasolines which form larger amounts of deposits on the heated aluminum tube cause the greatest octane requirement increase (ORI) when employed in an internal combustion engine.

Practice of the process of this invention will be apparent to those skilled in the art from the following wherein, as elsewhere in this description, all parts are parts by weight unless otherwise specified. An esterisk indicates a control example.

In this series of runs, the hydrocarbon fuel is an unleaded base fuel (UBF), containing the instant additive having the properties provided below in Table IV.

TABLE IV

| Property | Value |
|---|---|
| ibp (°F.) | 92 |
| 50% bp (°F.) | 216 |
| 90% bp (°F.) | 334 |
| API Gravity | 61.0 |
| RON | 93.2 |
| MON | 83.3 |

The gasoline contains 30% aromatics, 17% olefins, and 53% saturates.

In Example I, the reaction product of poly(oxyethylene) poly(oxypropylene) poly(oxyethylene) block copolymer, maleic anhydride and DUOMEEN T was used at 100 PTB in unleaded gasoline and tested by the Combustion Chamber Deposits Screening Test (CCDST). The amount of deposits formed on the tube after 100 minutes was then determined and reported in milligrams.

Also tested was a standard gasoline (Example A) known to yield a large deposit as the high reference and a standard unleaded gasoline (Example B) known to yield a low deposit as the low reference. The results were as follows:

TABLE

| Example | Sample of Example | CCDST (mg) |
|---|---|---|
| I | I | 6.5 |
| A | High Reference | 8.3 |
| B | Low Reference | 5.7 |

The instant invention yields equivalent amount of deposit as the low reference. Preferred motor fuel compositions for use with the reaction product additive set forth by the instant invention are those intended for use in spark ignition internal combustion engines. Such motor fuel compositions, generally referred to as gasoline base stocks, preferably comprise a mixture of hydrocarbons boiling in the gasoline boiling range, preferably from about 75° F. to about 450° F. This base fuel may consist of straight chains or branched chains or paraffins, cycloparaffins, olefins, aromatic hydrocarbons, or mixtures thereof. The base fuel can be derived from, among others, straight run naphtha, polymer gasoline, natural gasoline, or from catalytically cracked or thermally cracked hydrocarbons and catalytically reformed stock. The composition and octane level of the base fuel are not critical and any conventional motor fuel base can be employed in the practice of this invention.

In addition, the motor fuel composition may contain any of the additives generally employed in gasoline. Thus, the fuel composition can contain anti-knock compounds such as tetraethyl lead compounds, anti-icing additives, upper cylinder lubricating oils, and the like.

It is unexpected and surprising that the reaction product set forth by the instant invention is an effective ORI controlling agent when employed in minor amounts as an additive in motor fuels.

It will be evident that the terms and expressions employed herein are used as terms of description and not of limitation. There is no invention, in the use of these descriptive terms and expressions, of excluding equivalents of the features described and it is recognized that various modifications are possible within the scope of the invention claimed.

We claim:

1. A fuel composition for an internal combustion engine comprising:

(a) a major portion of a liquid hydrocarbon fuel and (b) a minor amount, as a deposit inhibitor additive, of a reaction product of a process comprising:

(i) reacting a dibasic acid anhydride with a polyol of the formula $$HO(CH_2CH_2O)_a(\underset{\underset{CH_3}{|}}{CH_2CH_2O})_b(CH_2CH_2O)_cH$$

where a+c is about 10 to about 80 and b is about 5 to about 70; thereby forming an ester of maleic acid;

(ii) reacting said ester of maleic acid with an N-alkyl-alkylene diamine, thereby forming the reaction product; and (iii) recovering said reaction product.

2. The fuel composition of claim 1, wherein said polyol has a molecular weight $\overline{M}_n$ ranging from about 800 to about 2000.

3. The fuel composition of claim 1, wherein said polyol reacts with a dibasic acid.

4. The fuel composition of claim 3, wherein said dibasic acid anhydride has the formula

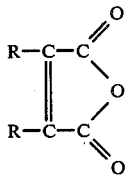

where R is H, $CH_3$— or $C_2H_5$—.

5. The fuel composition of claim 1, wherein said N-alkyl-alkylene diamine has the formula $$R'—NH—R''—NH_2$$

wherein R' is a ($C_{12}$–$C_{18}$) hydrocarbon group and R'' is a ($C_3$–$C_{12}$) hydrocarbon group.

6. A fuel composition for an internal combustion engine comprising:

(a) a major portion of a liquid hydrocarbon fuel having a boiling point of about 75° F. to about 450° F.; and (b) a minor amount, as a deposit-inhibiting additive of a reaction product of the process comprising:

(i) reacting a polyol $$HO(CH_2CH_2O)_a(\underset{\underset{CH_3}{|}}{CH_2CH_2O})_b(CH_2CH_2O)_c$$

where a+c is about 10 to about 80 and b is about 5 to about 70, with a dibasic acid anhydride

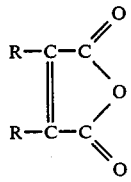

where R is H, $CH_3$— or $C_2H_5$—, thereby forming an ester of maleic acid;

(ii) reacting said ester of maleic acid with an N-alkyl alkylene diamine $$R'—NH—R''—NH_2$$

where R' is a ($C_{12}$–$C_{18}$) hydrocarbon group and R'' is ($C_3$–$C_{12}$) hydrocarbon group, thereby forming a reaction product

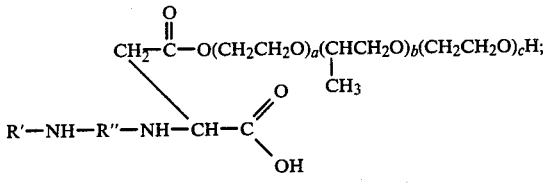

and (iii) recovering said reaction product.

7. A motor fuel composition according to claim 6 containing from about 0.001 to 0.01 weight percent of said reaction product.

8. A motor fuel composition according to claim 1 containing from about 0.001 to 0.01 weight percent of said reaction product.

9. The motor fuel composition of claim 1, wherein the process is carried out at a temperature of about 100° C. for about 2 hours.

10. The motor fuel composition of claim 6, wherein the process is carried out at a temperature of about 100° C. for about 2 hours.

* * * * *